US007208028B2

(12) United States Patent
Kim et al.

(10) Patent No.: US 7,208,028 B2
(45) Date of Patent: Apr. 24, 2007

(54) METHOD OF PRODUCING NANOPHASE W POWDER BY LOW-PRESSURE VAPOR PHASE REACTION

(75) Inventors: Byung Kee Kim, Busan-shi (KR); Jin Chun Kim, Gyoungsangnam-do (KR)

(73) Assignee: Korean Institute of Machinery and Materials, Daejon (KR)

( * ) Notice: Subject to any disclaimer, the term of this patent is extended or adjusted under 35 U.S.C. 154(b) by 188 days.

(21) Appl. No.: 10/747,695

(22) Filed: Dec. 30, 2003

(65) Prior Publication Data

US 2004/0211294 A1 Oct. 28, 2004

(30) Foreign Application Priority Data

Dec. 30, 2002 (KR) ..... 10-2002-0086722

(51) Int. Cl.
*B22F 9/28* (2006.01)

(52) U.S. Cl. ..... 75/362; 75/367

(58) Field of Classification Search ..... 75/362, 75/367

See application file for complete search history.

(56) References Cited

U.S. PATENT DOCUMENTS 5,788,738 A * 8/1998 Pirzada et al. ..... 75/331
6,846,345 B1 * 1/2005 Keller et al. ..... 75/255
2004/0219091 A1 * 11/2004 Kim et al. ..... 423/440

FOREIGN PATENT DOCUMENTS

WO WO-93/05877 * 4/1993

* cited by examiner

*Primary Examiner*—George P. Wyszomierski
(74) *Attorney, Agent, or Firm*—Lowe, Hauptman & Berner LLP

(57) ABSTRACT

W powder is produced by: preparing a precursor containing tungsten; producing gas by vaporizing or sublimating the precursor; separating the tungsten component by placing the gas in an inert atmosphere while maintaining pressure below atmospheric pressure; and condensing the tungsten component at pressure below atmospheric pressure.

6 Claims, 4 Drawing Sheets

METHOD OF PRODUCING NANOPHASE W POWDER BY LOW-PRESSURE VAPOR PHASE REACTION

RELATED APPLICATIONS

The present application is based on, and claims priority to Korean Application Serial Number 10-2002-0086722, filed Dec. 30, 2002, the disclosure of which is hereby incorporated by reference herein in its entirety.

TECHNICAL FIELD

The present invention relates to a method of producing nanophase powder, which is used as cemented carbide requiring high strength and wear-resistance, or materials for high-speed tool steel, heat-resistance steel etc., or more particularly, to a method of producing W powder of grade of several ten nanometers from a precursor containing tungsten by means of low-pressure vapor phase reaction.

BACKGROUND OF THE INVENTION

Generally commercialized W powder is produced in most cases by first purifying ammonium paratungsten from barite, followed by separating the same into $WO_3$ and undergoing multi-step reduction. Alternatively, it is produced by first producing $WO_3$ by using a method of dissolving scheelite in hydrochloric acid or by using a sodium carbonate method therein, followed by reduction thereof. However, these types of methods are problematic in that they involve a complicated process of multi-step purification and reduction, and lead to difficulties in preventing influx of impurities such as Mo, Mn, Ca, etc., which are added to the starting material powder. Further, with these types of methods, there are limitations in producing ultra-fine powder of 0.1 μm or less.

SUMMARY OF THE INVENTION

The present invention purports to provide a method of producing W cemented carbide powder of approximately 20 nm or below by a simpler process by using low-pressure vapor phase reaction.

In order to accomplish this objective, with respect to the method of producing W powder from a precursor containing tungsten, the present invention comprises the steps of preparing a precursor containing tungsten, producing gas by vaporizing or sublimating said precursor, and separating the tungsten component while placing said gas in an inert atmosphere at a pressure below atmospheric pressure, and condensing said tungsten component at pressure below atmospheric pressure.

DETAILED DESCRIPTION OF THE PREFERRED EMBODIMENT

The present invention is described in further detail as below. The present invention comprises producing nanophase powder by directly vaporizing or sublimating a precursor containing tungsten, and then by separating the tungsten component under vacuum pressure below atmospheric pressure, followed by condensation thereof Any precursors as long as they contain tungsten suffice as said precursor, and liquid-phase precursors, such as tungsten ethoxide solution or tungsten chloride ($WCl_6$) solution, or solid-phase precursors, such as tungsten hexacarbonyl ($W(CO)_6$), may be used.

The present invention comprises vaporizing or sublimating said precursor into gas, and then separating the tungsten component in gaseous state, followed by condensation.

Figure 1:
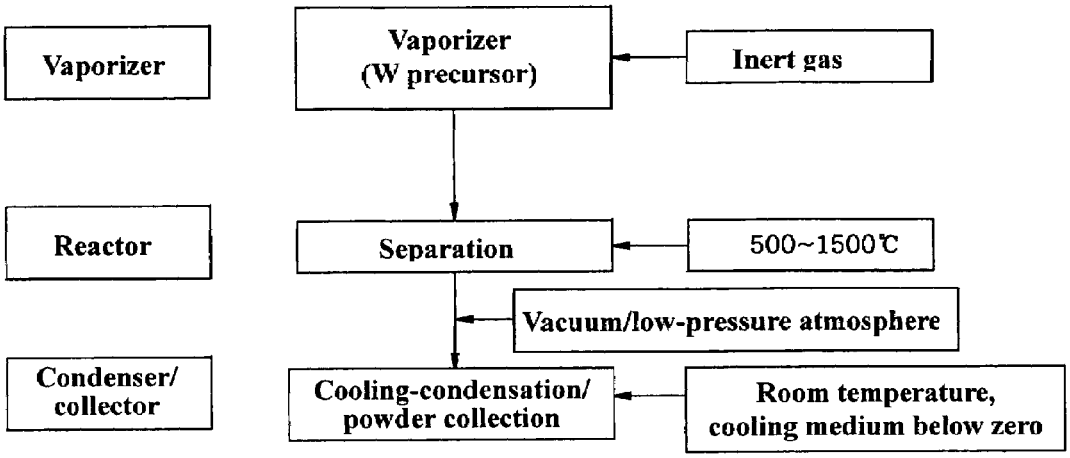
FIG. 1 is a flowchart for producing nanophase W powder according to the present invention.
Figure 2:
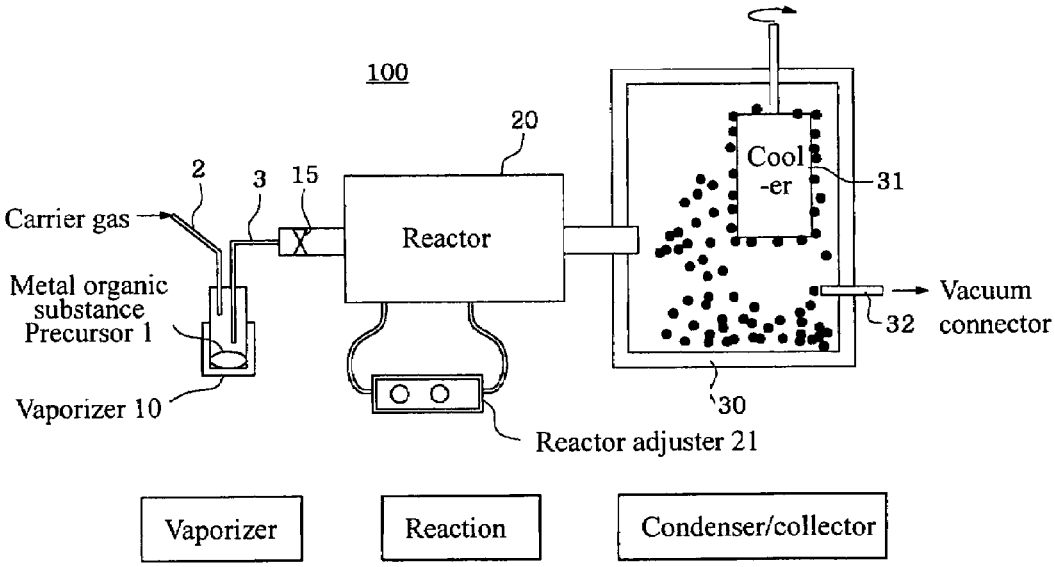
FIG. 2 is a structural diagram, which illustrates the apparatus for producing nonophase powder, which is used in the production method of the present invention.

FIG. 1 is a flowchart for producing nanophase powder according to the present invention, and FIG. 2 is a structural diagram, which exemplifies the apparatus for producing nanophase powder according to the present invention for vaporizing a precursor containing tungsten, separating a preferred embodiment of the tungsten component under an inert atmosphere and then condensing the tungsten comnonent.

As illustrated in FIG. 2, the apparatus 100 for producing nanophase powder by vapor phase reaction comprises a vaporizer 10, which vaporizes the precursor 1 fed from a storage vessel by means a pump (not illustrated); a reactor 20, which separates the tungsten component by heating said vaporized precursor; and a condenser 30 connected to said reactor 10.

The vaporizer 10 is connected with a carrier-gas feed pipe 2, and a mixed-gas feed pipe 3, which discharges the nixed gas of vaporized precursors and carrier gas. The vaporizer 10 feeds the mixed gas to the reactor 10.

The reactor 20 is connected with a reactor adjustor 21, which can adjust the temperature of the reactor. Further, a reactor valve 15 is installed between the vaporizer 10 and the reactor 20 for adjusting the flow rate of carrier gas.

Upon opening said reactor valve 15 for producing W powder, the mixed gas of the vaporized precursor and carrier gas is fed to the reactor 20, and then the tungsten component is separated out in vacuum below atmospheric pressure. The separated tungsten gas is supplied to the condenser 30 for condensation and collection, and the remainder gas is discharged to the discharge pipe 32.

The main characteristics of the present invention are as follows: By means of separation reaction of precursor gas, which is in gas phase at a molecular level, at vacuum pressure below atmospheric pressure, the separation reaction rate is fast, and by the same token, the size of the end-product powder, condensed after the completion of the separation reaction, is approximately 20 nm or less in nanophase. The vacuum pressure as above is set preferably at $1.3\times10^{-5}$ atm or higher but less than 1 atm. This is so because it would cost too much to maintain a reactor 20 at an ultra-vacuum state of less than $1.3\times10\text{-}^{5}$ atm.

The feed pipes (2,3) can be made of metal, such as stainless steel or copper, or ceramics or Teflon, such as alumina, mullite or silicon carbide. It is preferable to use a material which can withstand a temperature of 100~300° C. in the range of vaporization temperature of the precursor.

Further, the vaporizer 10 can be made of a stainless steel tube, alumina tube, quartz tube, or pyrex tube, with one end blocked off, which can withstand the vaporization temperature of the precursor.

Carrier gas can be selected, at least one, from He, Ar, $N_2$, or $H_2$, or the mixture thereof, which can form inert atmosphere, and the flow rate of gas of approximately 10~2,000 cc/min is appropriate.

Meanwhile, in case of using liquid-phase precursors, the flow rate of 0.05~2 cc/min is appropriate.

The reactor 20, in the shape of a horizontal tube, can be made of a stainless steel tube, quartz tube, mullite tube, alumina tube, etc. A heater is installed within said reactor 20.

In the present invention, it is important to maintain temperature in the reactor 20 so as to separate precursor gas into the W component and other components. It is preferable to maintain the reactor 20 in the temperature range of 500–1,500° C., or more preferably at 1,000~1,200° C. If it is 500° C. or less, the separation reaction does not occur actively, and in the interest of product yield and cost reduction, the upper limit should be preferably kept at 1,500° C. or lower. An inert atmosphere is maintained in the reactor 20 by means of carrier gas.

The W gas and the remainder component gas, pyrolyzed in the reactor 20 are fed into the condenser 30, in which the heavy W gas sinks naturally and condenses, or absorbs to the surface of a cooler installed within the condenser and condenses thereafter. The remainder gas of other light components is discharged to the discharge pipe 32. The cooler is filled with cooling medium of temperature at below zero, such as cooling water, liquid nitrogen or liquid helium, and by using such cooler, by way of the so-called thermophoresis effect, the absorption is carried out much faster than that of condensation by natural sinking. If the cooler is rotated, it further results in superior condensation efficiency.

Below, the present invention is described in further detail through an example. The example is for illustration purposes only and is not intended to limit the present invention to any specific form. It may be readily known to those skilled in the art that the present invention is not restricted to the example. It is intended that the scope of the present invention be defined by the claims appended hereto and their equivalents.

EXAMPLE

Tungsten hexacarbonyl, which is a noncorrosive solid-phase precursor, with a vaporization temperature of 120–170° C., was prepared and fed through the apparatus of FIG. 2. In feed, it was vaporized (vaporization temperature of 120° C.) and then fed into the reactor of an alumina tube of an outer diameter of approximately 40 mm and an inner diameter of approximately 30 mm. Argon gas was used as carrier gas. By means of heating the reactor, the vaporized precursor was separated into the tungsten component and other components at approximately 1,100° C.

Then, the W powder obtained as such was condensed and collected, after which was observed under an electron microscope. The results thereof are shown in FIGS. 3 and 4.

Figure 3:
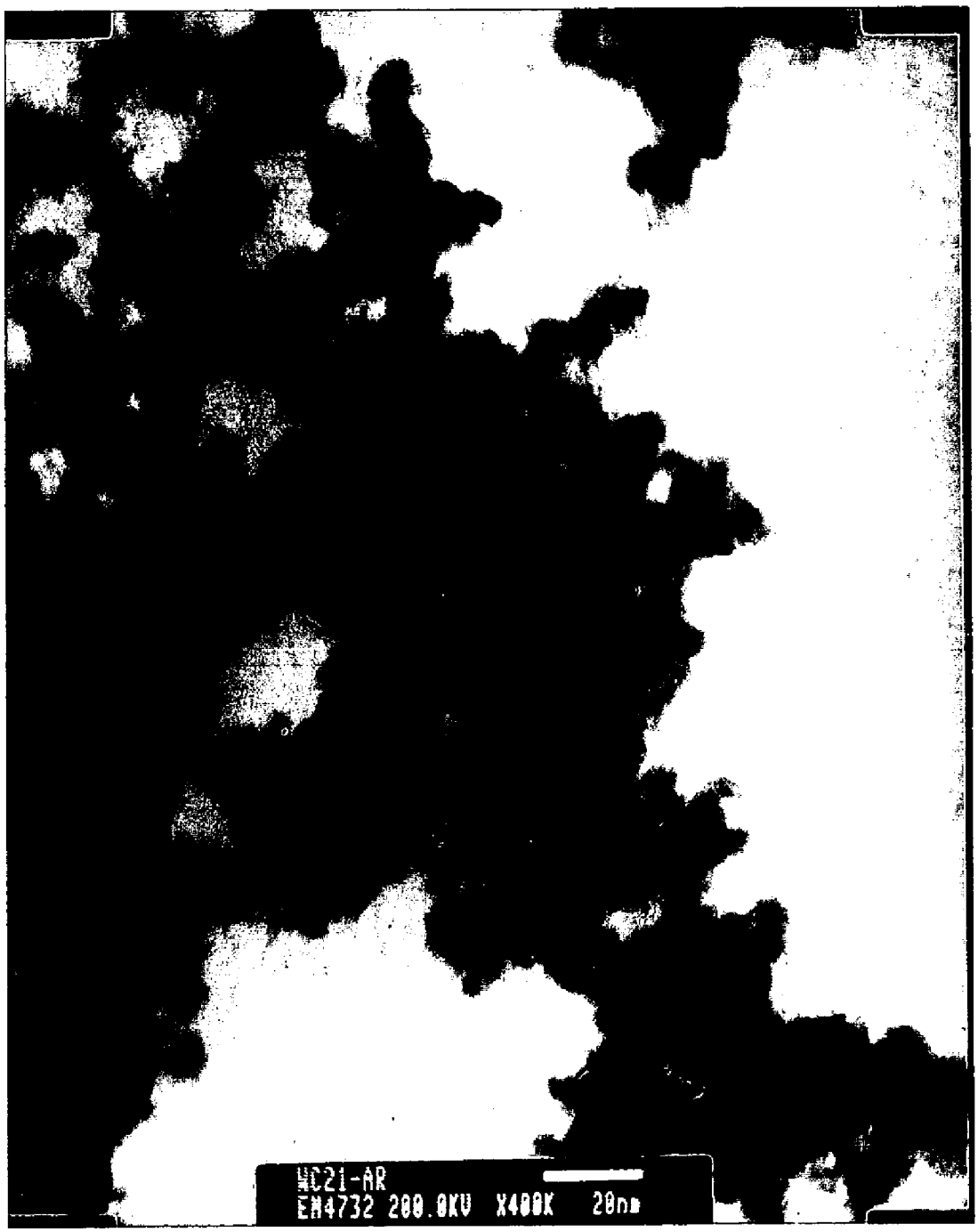
FIG. 3 is a photograph, which shows the structure of nanophase powder produced according to the present invention.
Figure 4:
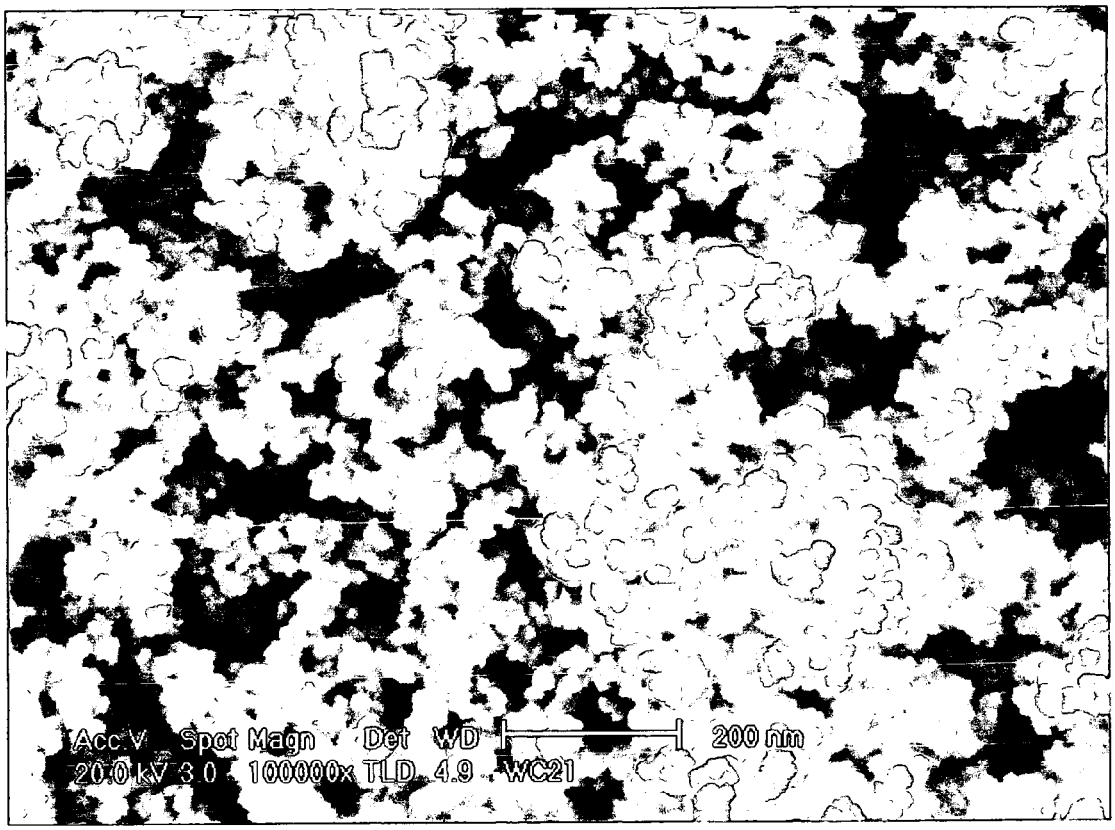
FIG. 4 is an FE-SEM photograph of nanophase powder produced according to the present invention.

As shown in FIGS. 3 and 4, the particle size of the resultant W powder produced according to the present invention was shown to be approximately 20 nm or less.

Figure 5:
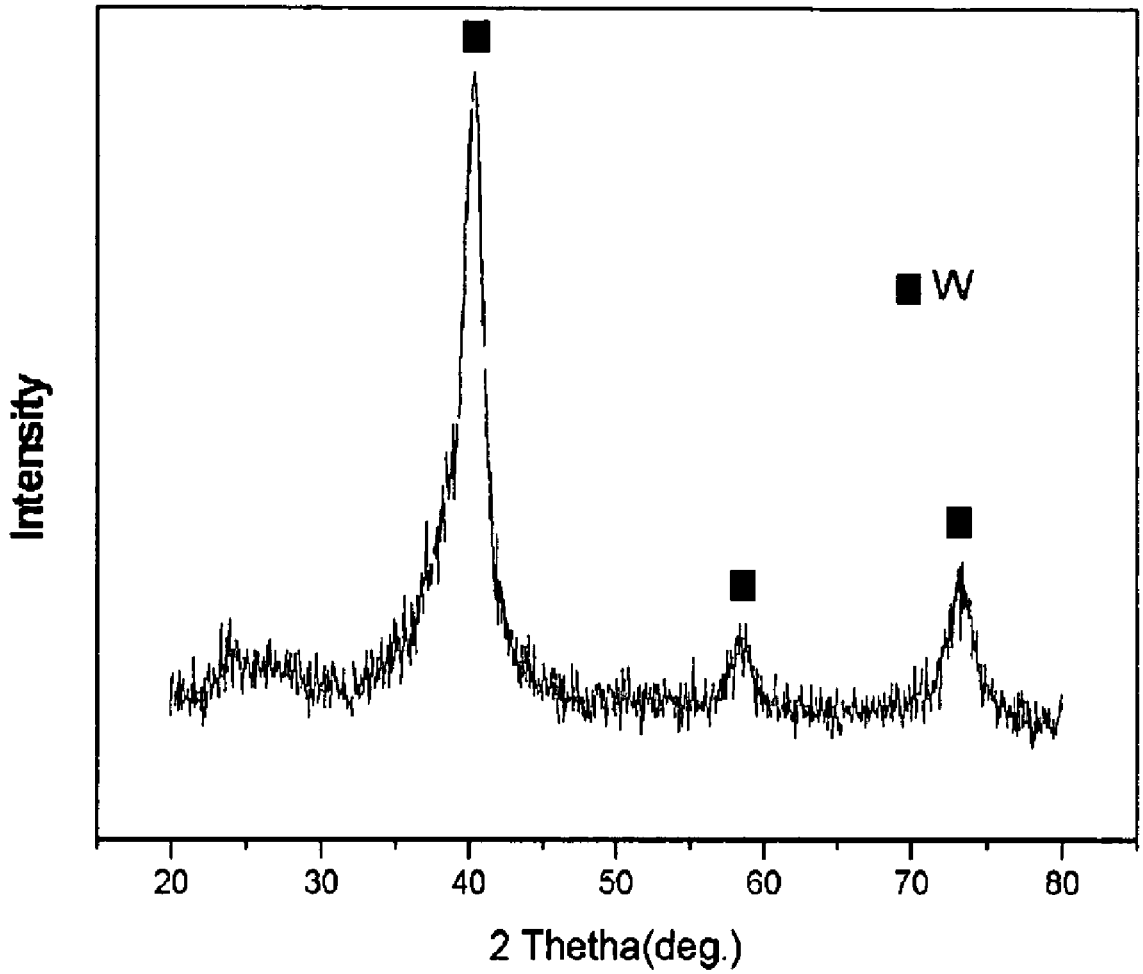
FIG. 5 is a graph, which shows the results of X-ray diffraction analysis of nanophase powder produced according to the present invention.

Further, the W powder produced according to the present invention was shown to have a peak width as illustrated in FIG. 5, and if this value is inserted into the mathematical equation showing the relationship between the peak width and the particle size for obtaining the value for its particle size, the calculation yielded the value of 20 nm or less.

INDUSTRIAL APPLICABILITY

As described in the specification, the present invention provides advantages in that the present invention is a simple process since it directly separates tungsten in gas phase by vaporizing or sublimating the tungsten precursor.

The resulting nanophase powder can be used as materials for cemented carbide, etc., which require high strength and wear resistance, to provide W powder of grade of several ten nanometers.

Further, the present invention provides W powder of grade of several ten nm by reaction and condensation of molecular-level gas in vacuum by means of low-pressure vapor reaction, and the nanophase powder produced thereby has high-strength and excellent wear-resistance, which can be suitably used as cemented carbide such as for carbide tools, or as materials for wear-resistance components or metal molds.

What is claimed is:

1. A method of producing nanophase W powder by low-pressure vapor phase reaction, which comprises the steps of preparing a precursor including tungsten; producing gas by vaporizing or sublimating said precursor; and separating the tungsten component by placing said gas in an inert atmosphere while maintaining pressure below atmospheric pressure; and condensing said tungsten component at pressure below atmospheric pressure, the precursor being selected from the group consisting of tungsten ethoxide, tungsten chloride, and tungsten hexacarbonyl.

2. The method of producing nanophase W powder by low-pressure vapor phase reaction according to claim 1, wherein said inert atmosphere comprises at least one of He, Ar, $N_2$, $H_2$ or a mixture thereof.

3. The method of producing nanophase W powder by low-pressure vapor phase reaction according to claim 2, wherein said step of separating the tungsten component by placing said gas in an inert atmosphere while maintaining pressure below atmospheric pressure is carried out at a temperature of 500–1,500° C.

4. The method of producing nanophase W powder by low-pressure vapor phase reaction according to claim 3, wherein said gas produced by vaporising or sublimating is condensed by absorbing the same onto the surface of a cooler at a temperature below 0° C.

5. The method of producing nanophase W powder by low-pressure vapor phase reaction according to claim 1, wherein said step of separating the tungsten component by placing said gas in an inert atmosphere while maintaining pressure below atmospheric pressure is carried out at a temperature of 500–1,500° C.

6. The method of producing nanophase W powder by low-pressure vapor phase reaction according to claim 1, wherein said gas produced by vaporising or sublimating is condensed by absorbing the same onto the surface of a cooler at a temperature below 0° C.

* * * * *